US008773318B2

(12) United States Patent
Pintos et al.

(10) Patent No.: US 8,773,318 B2
(45) Date of Patent: Jul. 8, 2014

(54) SYSTEM OF MULTI-BEAM ANTENNAS

(75) Inventors: Jean-François Pintos, Saint Blaise du Buis (FR); Ali Louzir, Rennes (FR); Dominique Lo Hine Tong, Rennes (FR)

(73) Assignee: Thomson Licensing (FR)

( * ) Notice: Subject to any disclaimer, the term of this patent is extended or adjusted under 35 U.S.C. 154(b) by 267 days.

(21) Appl. No.: 13/311,664

(22) Filed: Dec. 6, 2011

(65) Prior Publication Data

US 2012/0146879 A1 Jun. 14, 2012

(30) Foreign Application Priority Data

Dec. 8, 2010 (FR) ..... 10 60239

(51) Int. Cl.
*H01Q 19/06* (2006.01)

(52) U.S. Cl.
USPC ..... 343/754; 343/844; 343/853; 343/893

(58) Field of Classification Search
USPC ..... 343/754, 893, 850, 853, 844; 342/367, 342/368, 370, 372
See application file for complete search history.

(56) References Cited

U.S. PATENT DOCUMENTS 3,731,313 A * 5/1973 Nagai ..... 342/370
3,757,335 A * 9/1973 Gruenberg ..... 342/367
8,466,776 B2 * 6/2013 Fink et al. ..... 340/10.4

FOREIGN PATENT DOCUMENTS

EP 2058900 5/2009

OTHER PUBLICATIONS

Hong Tzung-Jir et al : "24 GHz active retredirective antenna array", Electronic Letters, IEE Stevenage, GB, vol. 35, No. 21, Oct. 14, 1999, pp. 1785-1786, XP006012804.
Karode S L et al: "Near field focusing properties of an integrated retrodirective antenna", Antennas Propagation, 1999, IEE National Conference on. York, UK Mar. 31-Apr. 1, 1999, London, UK, IEE, UK, Mar. 31, 1999.
Karode S L. et al.: "Multiple target tracking using retrodirective antenna arrays", Antennas and Propagation, 1999. IEE National Conference on. York, UK Mar. 31-Apr. 1, 1999, London, UK, IEE, UK.
EP Search Report dated Jul. 7, 2011.

* cited by examiner

*Primary Examiner* — Hoang V Nguyen
(74) *Attorney, Agent, or Firm* — Jack Schwartz and Associates, PLLC

(57) ABSTRACT

The present invention relates to a system of multi-beam antennas comprising a network of N radiating elements, N being an even whole number, the elements of the network being connected two by two via transmission lines. The system comprises in addition M radiating sources, M being a whole number greater than or equal to 1, the radiating source (s) each being positioned at a distance Li from the center of the network such that the distance Li is strictly less than the distance of fields called far fields and i varies from 1 to M. This system can be used notably in MIMO devices.

10 Claims, 4 Drawing Sheets

SYSTEM OF MULTI-BEAM ANTENNAS

This application claims the benefit, under 35 U.S.C. §119 of FR Patent Application 1060239, filed 8 Dec. 2010.

The present invention relates to a multi-beam antenna system, particularly a multi-beam antenna system that can be used in the context of wireless communications, more particularly in wireless domestic networks in which the conditions for propagation of electromagnetic waves are very penalizing due to multiple paths.

BACKGROUND OF THE INVENTION

For emerging applications such as wireless domestic networks, intelligent networks or similar type networks, the use of directive antennas, that is antennas able to focus the radiated power in a particular direction of the space are proving particularly attractive. However, the laws of physics impose a minimum size for antennas, this size being all the more significant as the antenna is more directive or as its operating frequency is low.

Up until now, the use of directive antennas has remained limited to applications operating at very high frequencies, often with fixed beams, and do not have size constraints such as those of radar applications or satellite applications. Thus, for these application types, antenna devices are known that generate multiple beams but are composed of numerous modules that are often complex and costly. Conversely, antenna devices called retro-directive antennas enable directive beams to be formed very simply in a privileged direction of the space. Retro-directive antenna networks are based on the fact that each antenna of the network receives the incident signal of a source with a characteristic path-length difference, that is to say a different phase. This phase difference is characteristic of the direction of the emitting source. In fact, so that the signal to be sent is emitted in the direction of the source, it suffices that the phase difference between each antenna at transmission is opposite to that in reception so as to anticipate the path-length difference on the return path.

Among retro-directive antennas, the most well known network is the network call the "Van-Atta" network which is described, notably, in the U.S. Pat. No. 2,908,002 of 6 Oct. 1959. As shown in FIG. 1, a Van-Atta type retro-directive network is constituted of a number of radiating elements 1*a*, 1*b*, 2*a*, 2*b*, 3*a*, 3*b* that are symmetric with respect to the central axis Oy of the network. The radiating elements are connected by pairs, the radiating element 1*a* being connected to the radiating element 1*b*, the radiating element 2*a* connected to the radiating element 2*b*, the radiating element 3*a* connected to the radiating element 3*b*, via transmission lines 1, 2, 3 having equal electrical lengths, the antennas being symmetrically opposed with respect to the central axis of the network. In this case, the phase difference induced by the transmission lines is thus the same on all the radiating elements and the phase difference between two consecutive radiating elements is the same in reception of the signal and in transmission of the signal retro-directed to the closest sign. The phase differences between the signals of radiating elements of the transmitting network are thus opposed to the phase differences between the signals of the radiating elements of the receiving network. A retro-directivity of the transmitted signal is thus obtained.

However, this method has a certain number of significant disadvantages. To obtain the retro-directivity of the signal, the front of the incident wave must be flat. In addition, the antenna network must be flat or more or less symmetric with respect to the network centre. As the front of the incident wave must be flat, it is necessary that the network of radiating elements is positioned in the field area far from the transmitter source. As a result, the applications of Van-Atta type networks have only been, up to now, satellite or radar type applications.

As a result of studies made on these types of retro-directive networks, the present invention proposes to use the principle of a network of radiating elements to produce a system of multi-beam antennas that can be used in wireless communications, notably in wireless domestic networks or in peer to peer type networks communicating via wireless links, more specifically, in the scope of MIMO (Multiple Input Multiple Output) systems but also in antenna systems with a single antenna associated with processing systems operating with directive antennas.

SUMMARY OF THE INVENTION

Thus the purpose of the present invention is, a system of multi-beam antennas comprising a network of N radiating elements, N being an even integer, the elements of the network being connected two by two via transmission lines, characterized in that it comprises more than M radiating sources, M being an integer greater than or equal to 1, the radiating source(s) each being positioned at a distance Li from the centre of the network so that the distance Li is strictly less than the distance of fields called far fields and i varies from 1 to M. The notions of far field and close field were described particularly in an article of the IEEE Antennas and Propagation Magazine vol. 46, No. 5, October 2004 entitled <<Radiating Zone Boundaries of Short $\lambda/2$ and $\lambda$ Dipoles>>. Thus for a source of small dimensions vis-à-vis the wavelength, the distance Li is less than $1.6\lambda$ where $\lambda$ is the wavelength at the operating frequency (in air $\lambda=\lambda_0$, and in a different medium $\lambda=\lambda_g$, such that $$\lambda_g = \frac{\lambda_0}{\sqrt{\varepsilon_r \cdot \mu_r}}$$

with $\epsilon_r$ and $\mu_r$ the permittivity and permeability of the medium)

According to a preferred embodiment, the elements of the network are connected two by two symmetrically via transmission lines having a same electrical length and the number of radiating sources is strictly greater than 1. Preferably, in the scope of a MIMO system, the number of radiating sources is equal to the number of inputs of the MIMO system.

According to another embodiment, the multi-beam antenna system comprises a radiating source and the directivity of beams is obtained by integrating into at least one of the transmission lines, an active circuit enabling the phase difference of the line to be modified. For example, the active circuit can be a hybrid coupler or a filter of the type of those described in the French patent application number 09 58282 filed 23 Nov. 2010 in the name of THOMSON Licensing.

According to another embodiment, a passive filter introducing a constant phase difference and enabling a frequency filtering is introduced in the transmission lines connecting 2 by 2 the elements of the network enabling for example in reception, improvement of the noise rejection or in transmission, reduction of parasite radiation from the radiating source.

According to different embodiments of the present invention, the radiating elements of the network are constituted by elements selected from among monopoles, patches, slots, horn antennas or similar elements. Likewise, the radiating sources are also constituted by sources selected from among monopoles, dipoles, patches, slots, horn antennas or similar elements.

According to a preferred embodiment, in the case of use of monopoles as radiating elements of the network, the monopoles have dimensions $d=\lambda/4$ where $\lambda$ is the wavelength at the operating frequency. In addition, the distance of each radiating element is a multiple of $\lambda/4$ where $\lambda$ is the wavelength at the operating frequency. It is evident that other distances can be considered without leaving the scope of the present invention.

In addition, when the system has several radiating sources, according to an embodiment, one of the radiating sources is positioned according to the axis of symmetry of the network of radiating elements, the other sources being offset at an angle $\theta i$ with i varying from 2 to M. According to another embodiment, the sources are symmetrical with respect to the central axis of the network and are offset at an angle $\theta i$ with i varying from 2 to M.

BRIEF DESCRIPTION OF THE DRAWINGS

Other characteristics and advantages of the present invention will emerge upon reading the following description of several embodiments, this description being made with reference to the drawings attached in the appendix, in which.

DETAILED DESCRIPTION OF THE EMBODIMENTS OF THE INVENTION

Figure 1:
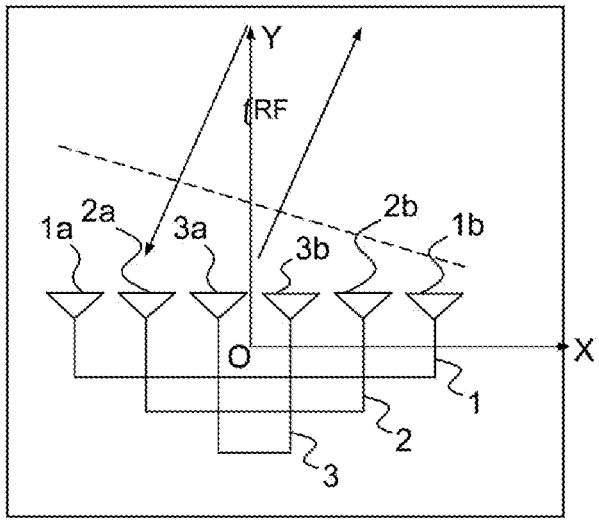
FIG. 1 already described is a diagrammatic representation of a Van Atta type retro-directive network.
Figure 2A:
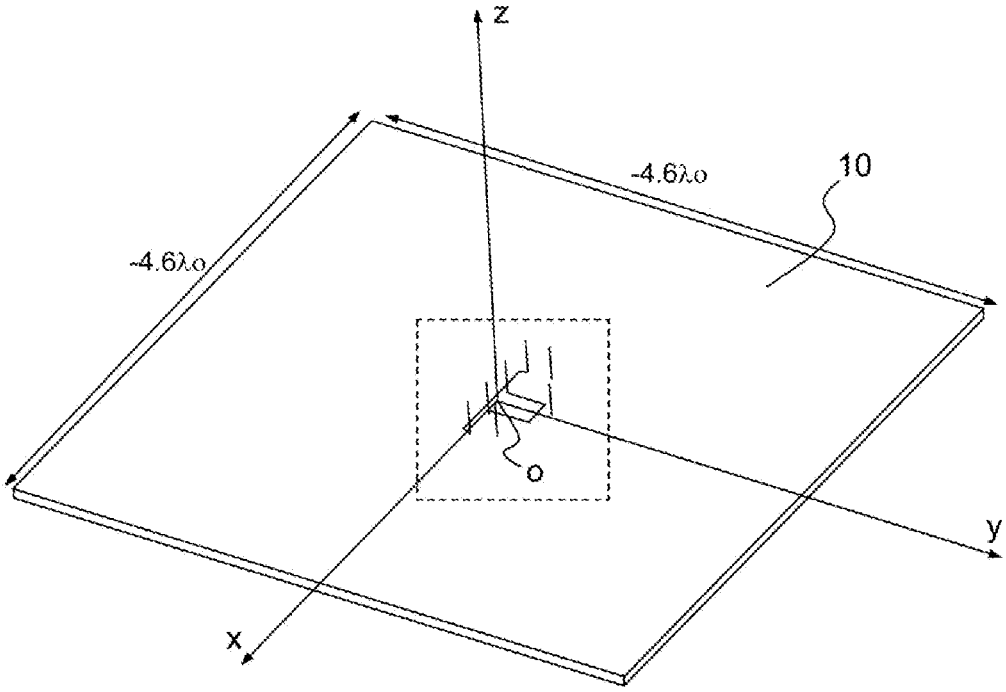
FIG. 2A is a diagrammatic perspective view of a first embodiment of a multi-beam antenna system in accordance with the present invention, FIG. 2B representing an enlarged part of the multi-beam antenna system of FIG. 2A.

A description will first be given, with reference to FIGS. 2, 3 and 4 of a first embodiment of a multi-beam antenna system in accordance with the present invention. On a substrate 10 of large dimensions provided with a ground plane, a system has been implemented comprising a network of Van Atta type monopoles and several sources, the monopoles being positioned in the field close to the sources, as will be described in more detail hereafter.

In the embodiment shown, the substrate is a square of length $L=4.6\lambda$ where $\lambda$ is the wavelength at the operating frequency (in air $\lambda=\lambda 0$). As shown in more detail in FIG. 2B, the antenna part is constitute of a network of 4 elements 11*a*, 11*b*, 12*a* and 12*b* formed, in the embodiment shown, by monopoles of height $h\sim\lambda_0/4$. The monopoles 11*a*, 12*a*, 12*b*, 11*b* are each separated by a distance d and connected two by two via a network of lines implemented in microstrip technology that, in the embodiment shown, are of Van Atta type, that is to say the lines connecting the two monopoles are of the same electrical length to obtain a same phase. More specifically, the two external monopoles 11*a* and 11*b* are connected via the line 11 while the monopole 12*a* is connected to the monopole 12*b* via the line 12, the whole being symmetrical with respect to the axis Oy.

In the embodiment represented above, a Van Atta type network has been used, however it is clear to those skilled in the art that a different network enabling control of the direction of the beam returned to the source can also be used. Moreover, the elements of the network shown are monopole. However it is evident to those skilled in the art that other element types for the network can be used, particularly patches or slots, as will be described hereafter.

In accordance with the present invention, several radiating sources are positioned opposite the monopole network at a distance Li from the network. The distance Li is selected in a way to reduce the total size of the antenna system. In the present case it is less than the distance of the far field. For antennas whose dimensions are close to or less than the wavelength ($\lambda_0$), the distance Li is less than $1.6\lambda_0$ where $\lambda_0$ is the wavelength at the operating frequency. Hence, in the embodiment shown in FIG. 2B, a first source S1 central in relation to the axis Oy corresponding to the axis of symmetry of the network is positioned at a distance L from the centre of the network, a second source S2 is positioned at a distance LS1 from the centre of the network and a third source S3 is positioned symmetrically at S2 with respect to the source S1 at a distance LS1 from the centre of the network. As a result, the sources S1 and S2 are offset at an angle $\theta i$ with respect to the source S1.

In the embodiment shown, the sources S1, S2 and S3 are constituted by monopoles of height $\lambda_0/4$. However it is evident to those skilled in the art that other radiating source types can be considered. One of the conditions to be respected in order to obtain a compact multi-beam antenna system is that the network of N radiating elements is located in the area of the field close to the source or sources. This condition is obtained by placing the source at a distance comprised between $\lambda_0$ and $1.6\lambda_0$ from the centre of the network with $\lambda_0$ the wavelength at the operating frequency if the source has dimensions close to or less than $\lambda_0$. In the contrary case, the distance of the far field is determined by the formula well known to those skilled in the art $2*D^2/\lambda_0$ where D is the biggest dimension of the antenna.

Figure 2B:
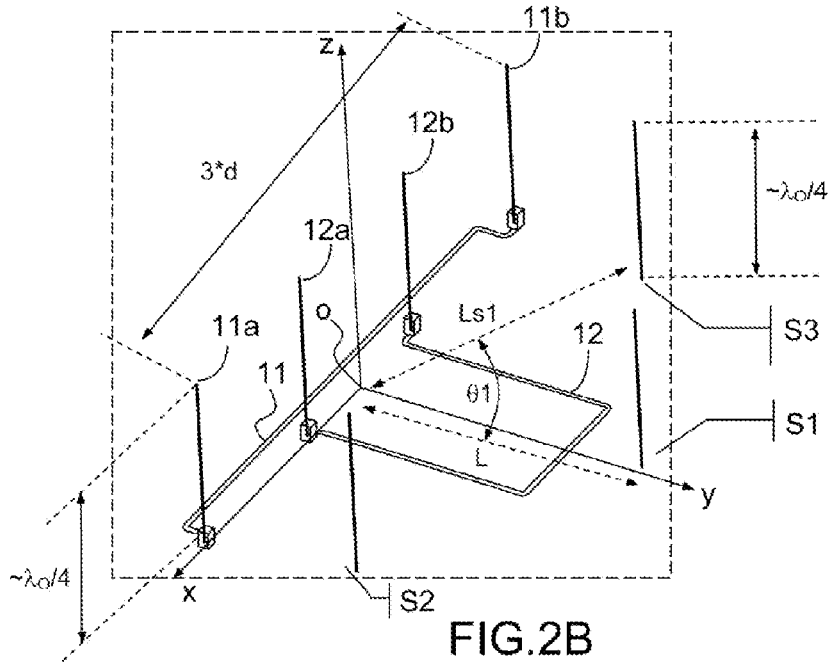

The embodiment of FIG. 2B was simulated using a 3D (HFSS) electromagnetic simulator of the company ANSYS. Taking into account the mutual coupling, the simulations were carried out using two different values for the deviation between the network elements, namely $d=\lambda_0/2$ for a first embodiment and $d=\lambda_0/4$ for a second embodiment, the other dimensions, namely the distance $L=0.4\lambda_0$, the distance $LS1=X_0$ and the angle $\theta 1=60°$ being identical for the two embodiments.

Figure 3:
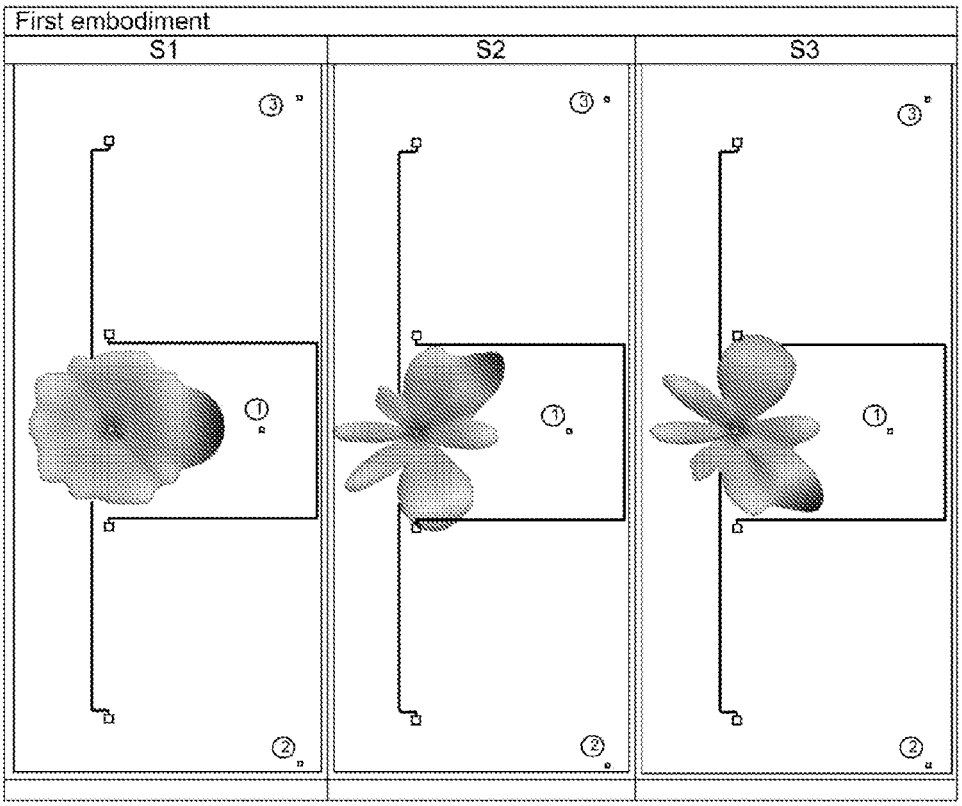
FIG. 3 shows the radiation patterns of a multi-beam system such as that shown in FIG. 2 for a first value of the distance between elements of the network and according to sources used.
Figure 4:
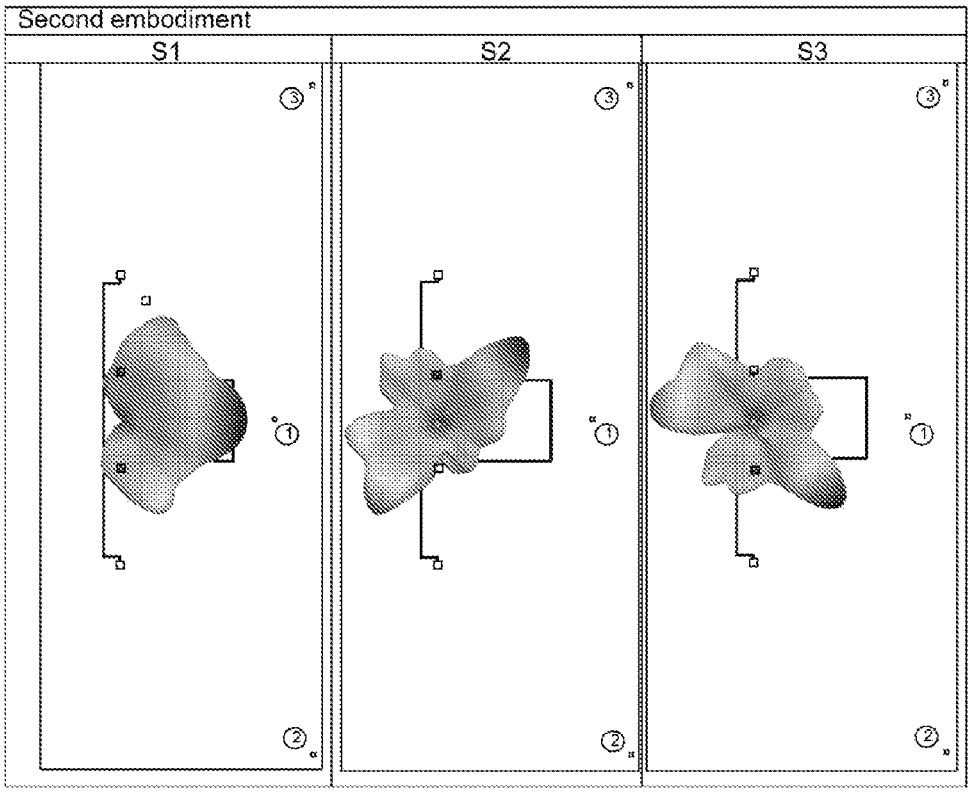
FIG. 4 shows the radiation patterns of a second embodiment such as that shown in FIG. 2 for a second value of the distance between elements of the network and according to sources used.

FIG. 3 shows the results obtained for the first embodiment while FIG. 4 shows the results obtained for the second embodiment.

In these figures, the sources excited are represented by a black circle. When a source is excited, it radiates in an omnidirectional way in the azimuthal plane. As a result, the source illuminates the network and each element of the network captures part of the signal. This is re-injected towards the element that is itself connected via the corresponding microstrip line. The resulting pattern is the superimposition of the radiation of the source and the network. It will be noted in FIG. 3 that the pattern is orientated in different directions according to the position of the excited source, which enables a multi-beam system to be obtained with the system represented in FIG. 2B as a directive radiation of the network is obtained. This radiation can be modified by inserting an active part into the network to minimise the radiation of the source. The contributions of sources and of the network can be modified by changing the distance between the sources and the network (coupling+/−strong) but also by inserting for example a bi-directional amplification circuit into the network at the level of transmission lines. It can be easily understood that as a result the network will have a stronger contribution than the excitation source. This also offers an advantage in reception with respect to the noise, as the amplification occurs more upstream in the chain. Consequently this enables increasing the signal to noise ratio of the entire device.

Figure 5:
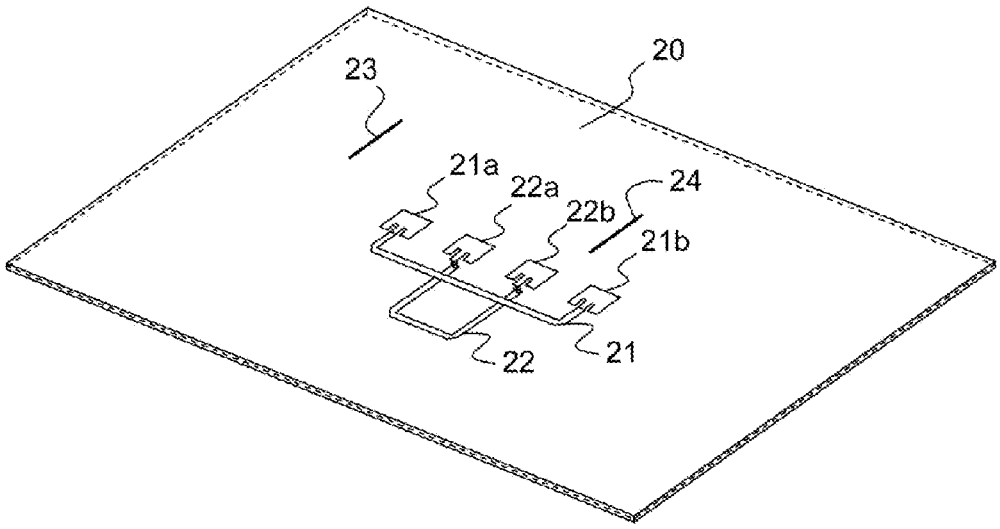
FIG. 5 is a diagrammatic perspective view of a second embodiment of the present invention.

In the second embodiment, the inter-element distance of the network is lower. As the sources are placed at the same distance with respect to the centre of the network, the phase and amplitude difference between the extreme elements of the network is thus reduced. It will be noted that, as shown in FIG. 4, the radiation patterns obtained are more accentuated concerning their directivity. In fact, the maximum radiation obtained is not in the direction of the source but in a different direction, as shown for the sources S2 and S3. By using a system of multi-beam antennas in accordance with the present invention, it is thus possible to obtain multiple beams in privileged directions simultaneously. This system can thus be easily integrated with MIMO type devices, each input of the MIMO being connected to one of the sources S1, S2 or S3 or via a beam selection device. We will now describe with reference to FIGS. 5 to 7, a different embodiment of the present invention. In this embodiment, on a substrate 20 constituted, for example of a multi-layer substrate of type FR4 ($\epsilon_r$=4.4, tan $\delta$=0.02) of 3 conductive layers, a network has been produced of 4 "patch" type radiating elements. The patches 21*a*, 22*a*, 22*b*, 21*b* are half-wave patches printed on the substrate and spaced from each other at a distance $\lambda_0/2$ at the frequency of 5.7 GHz. As shown in FIG. 5, the patches are connected two by two (21*a* and 21*b*, 22*a* and 22*b*) via transmission lines 21 and 22 of the same electrical length. The transmission lines are constituted via line produced in microstrip technology of width 2.69 mm and thickness 1.4 mm, in the embodiment shown. They are arranged on two sides of the substrate to avoid any crossing over, the line of the underside being connected to the network elements via metalized holes.

In the embodiment of FIG. 5, the radiating sources are constituted by two dipoles 23, 24 of length $\lambda_0/2$ at the frequency of 5.7 GHz and of diameter of 1 mm. The dipoles 23, 24 are positioned at a distance of $1.1\lambda_0$ from the centre of the network and at an angle of 60° with respect to the normal that passes via the centre of the network.

Figure 6A:
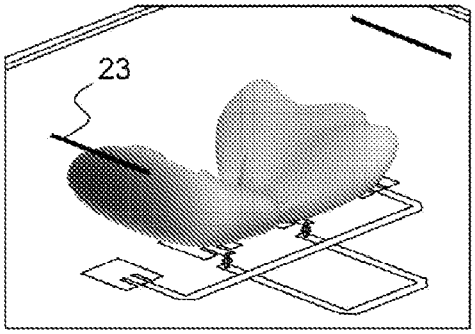
FIGS. 6A and 6B show in 3D the radiation patterns of the embodiment of FIG. 5 according to the source used.
Figure 6B:
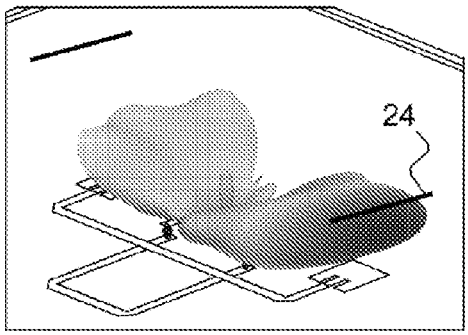
Figure 7A:
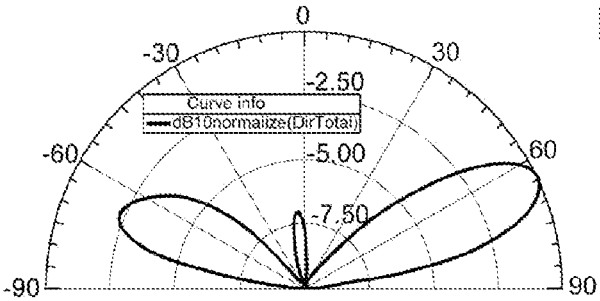
FIGS. 7A and 7B show a 2D cross-section according to an orthogonal plan of the sources of patterns of FIGS. 6A and 6B.
Figure 7B:
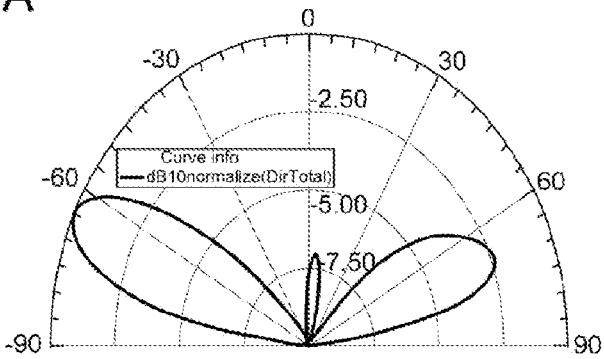

Simulations of the antenna system described above were carried out using the same tool as was used for the other embodiment described. FIGS. 6A and 7A show the radiation pattern obtained when the dipole 23 is used while FIGS. 6B and 7B show the radiation pattern obtained when dipole 24 is used. An angular deviation of the beam can be clearly seen on these different patterns in the direction of the source selected.

Thus by associating a network of Van Atta type or similar type radiating elements in the field close to one or several radiating sources, it is possible to construct a multi-beam system that can be used notably in a MIMO device, and this even if the behaviour of the network is not perfectly retro-directive.

What is claimed is:

1. A system of multi-beam antennas comprising on a face of a substrate a network of N radiating elements, N being an integer, the elements of the network being connected two by two via transmission lines, wherein the system comprises, on the same face of said substrate, M radiating sources, M being an integer greater than or equal to 1, the radiating source(s) being positioned each at a distance Li from the centre of the network such that the distance Li is strictly less than the distance of a field called the far field and i varies from 1 to M.

2. A system of multi-beam antennas according to claim 1, wherein the radiating elements of the network are connected two by two symmetrically via transmission lines having a same electrical length and the number of radiating sources is strictly greater than 1.

3. A system of multi-beam antennas according to claim 1, wherein the system of multi-beam antennas comprises a radiating source and the directivity of radiation beams is obtained by integrating into at least one of the transmission lines, an active or passive circuit enabling the phase difference of the line to be modified.

4. A system of multi-beam antennas according to claim 3, wherein the active circuit is selected from among hybrid couplers or active filters.

5. A system of multi-beam antennas according to claim 3, wherein the passive circuit is a passive filter.

6. A system of multi-beam antennas according to claim 1, wherein the radiating elements of the network are constituted of elements selected from among the monopoles, patches, slots or horn antennas.

7. A system of multi-beam antennas according to claim 1, wherein the radiating sources are constituted of sources selected from among the monopoles, dipoles, patches, slots or horn antennas.

8. A system of multi-beam antennas according to claim 1, wherein, when the system has several radiating sources, one of the radiating sources is positioned according to an axis of symmetry of the network of radiating elements, the other sources being offset at an angle $\theta i$ with i varying from 2 to M.

9. A system of multi-beam antennas according to claim 1, wherein, when the system has several radiating sources, the sources are symmetrical with respect to the central axis of the network and are offset at an angle $\theta i$ with i varying from 2 to M.

10. A system of multi-beam antennas according to claim 1, wherein the distance Li has a length less than $1.6\lambda$ where $\lambda$ is the wavelength at the operating frequency.

* * * * *